United States Patent [19]

Little et al.

[11] Patent Number: 4,708,893

[45] Date of Patent: Nov. 24, 1987

[54] METHOD FOR MAKING FABRIC ROSES

[76] Inventors: John D. Little; Lorianne C. Little, both of 26131 Tono, Mission Viejo, Calif. 92692; John Wood, 160 Centennial Ave., Chico, Calif. 95928

[21] Appl. No.: 865,538

[22] Filed: May 21, 1986

[51] Int. Cl.[4] ..... A41G 1/00

[52] U.S. Cl. ..... 428/26; 156/61

[58] Field of Search ..... 428/24, 25, 26; 156/61

[56] References Cited

U.S. PATENT DOCUMENTS

| | | | |
|---|---|---|---|
| 1,766,351 | 6/1930 | Patterson | 428/26 |
| 2,697,892 | 12/1954 | Haas | 428/25 |
| 3,922,407 | 11/1975 | Nimmo, Jr. et al. | 428/24 X |
| 4,525,394 | 6/1985 | Standley | 428/26 |

*Primary Examiner*—Henry F. Epstein

*Attorney, Agent, or Firm*—Hubbard, Thurman, Turner & Tucker

[57] ABSTRACT

A method for making fabric roses is disclosed. The method involves inserting a fabric ribbon between two needle devices which are adapted to hold the fabric ribbon. The needle devices are then rotated by means of a variable speed motor, thus rotating the fabric ribbon. As the fabric ribbon portion rotates, a center portion for a rose is produced. The ribbon is then folded numerous times in a direction away from the two needle devices in order to form the petals of a fabric rose. Once the rose is completed, it is removed from the needle devices and finished by heat-sealing the portions of the ribbon that form the base of the rose. Additional decorative items, such as leaves, ribbon loops and lace may be attached to the fabric roses.

9 Claims, 4 Drawing Figures

METHOD FOR MAKING FABRIC ROSES

BACKGROUND OF THE INVENTION

1. Field Of The Invention

The present invention relates to a method for making fabric roses for garment application.

2. Description Of The Prior Art

Prior to the present invention, fabric roses for garment applications were inconsistent in quality due to nonuniformity in size and shape. The nonuniformity of the fabric roses made by prior art processes made undesirable the use of more than one rose on a single garment.

Also prior to the present invention, the sealing of the base of fabric roses after formation was accomplished by sewing the rose through its middle to hold its shape. After sewing, scissors were used to cut off excess material. This method of sealing the base of the rose was, at best, temporary, as the thread would often unravel or break.

Also prior to the present invention, the production of decorative leaves used in conjunction with fabric roses was time-consuming, as each leaf was cut separately by hand. Since the leaves were cut by hand, they were also nonuniform. Moreover, attaching the leaf to a fabric rose was time-consuming and burdensome, as each leaf was sewn to the rose. This process was not only slow, but was cosmetically unappealing, as the thread was bunched at the base of the rose.

SUMMARY OF THE INVENTION

The present invention is directed to a method for making fabric roses that avoids the above-mentioned disadvantages which are characteristic of the prior art. More specifically, the method of the present invention allows the production of fabric roses having consistent, uniform and reproducible quality, size and shape. The method of the present invention allows garment manufacturers to freely use more than one fabric rose on a single garment, as the roses all appear uniform in size and shape. Indeed the fabric roses produced according to the present invention can be used as buttons down the front of a blouse. The present invention also yields approximately an eight-fold production increase and a one-half training time reduction over prior art methods for making fabric roses.

Additionally, the present invention provides an improved sealing process that dramatically increases the production of fabric roses. According to the present invention, upon completion of the rose petals, the fabric used to make the rose is melted across a heated blade or tip. Since the fibers in the fabric are returned to their liquid state upon melting they are permanently fused together upon cooling. Excess material is disposed of simultaneously with the melting of the fabric to produce a finished rose. The durability of this heat seal is much greater compared to the prior art sewing techniques. The heat seal does not come apart, whereas the prior art sewing seal does come apart after a garment with such roses has been washed several times.

The present invention also provides an improved method for producing leaves for fabric roses. According to the present invention, a heated template in a desired leaf shape is utilized to cut the leaves from fabric. This improvement has increased the production of leaves for fabric roses approximately three-fold over prior art methods. Also, according to the present invention, the leaves are advantageously attached to the fabric roses, by utilizing a heated soldering iron or other heated tip, which avoids the bunching of thread at the base of the rose, as in the prior art methods. This improvement has increased the production of fabric roses with leaves approximately eight-fold over prior art methods.

BRIEF DESCRIPTION OF THE DRAWINGS

In describing the present invention, reference will be made to the accompanying drawings in which.

DETAILED DESCRIPTION OF THE PREFERRED EMBODIMENTS

Figure 1:
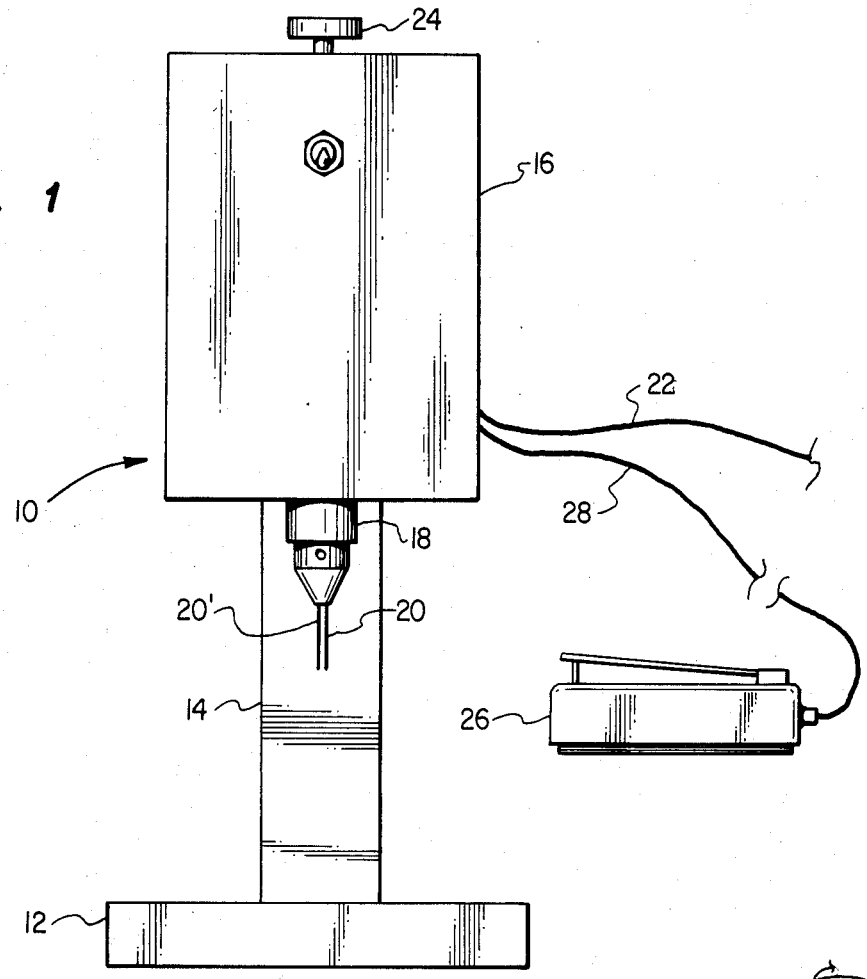
FIG. 1 is a perspective view of a device which is utilized in carrying out the present invention.
Figure 2:
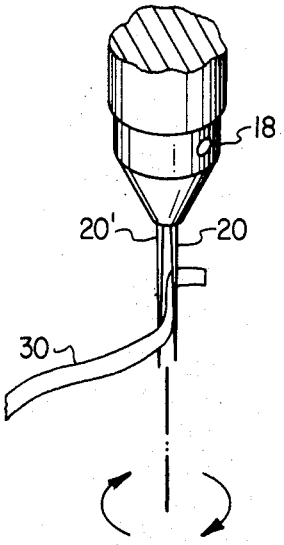
FIG. 2 is a detailed view of a portion of the device depicted in FIG. 1.

Referring now to the drawings, and in particular FIG. 1, a device generally indicated at 10 has a base 12, a rod 14 and a motor box 16. The motor box 16 is supported above the base 12 by rod 14. A chuck 18 is disposed at the bottom of the motor box 16, and needle devices 20, 20' extend from the chuck 18. As shown in more detail in FIG. 2, the chuck 18 may be manipulated to narrow or increase the distance between needle devices 20, 20'. When the distance between the needle devices 20, 20' is narrowed, the needle devices 20, 20' are adapted to hold a piece of fabric ribbon 30. A motor (not shown) is disposed within the motor box 16. Electricity is provided to the motor in motor box 16 through cord 22. The motor in motor box 16 is preferably a variable speed motor and the speed of the motor, preferably, may be varied by a motor speed adjusting knob, generally indicated at 24. A foot pedal device 26 for operating the motor in motor box 16 is connected to the motor by cord 28. When the foot pedal device 26 is depressed to activate the motor in motor box 16, the chuck 18 rotates. As shown in more detail in FIG. 2, when the chuck 18 rotates the needle devices 20, 20' also rotate.

Figure 3:
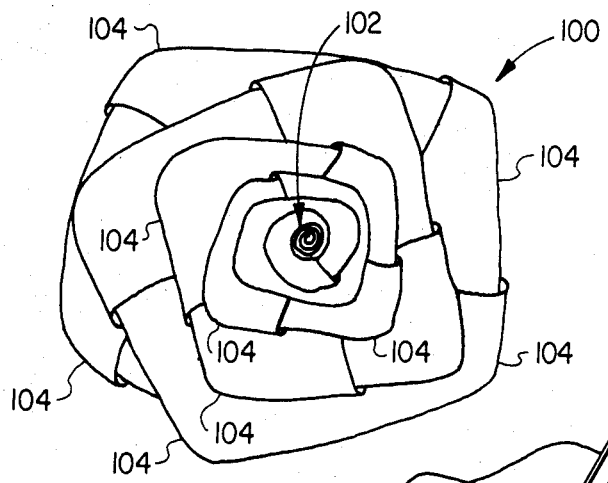
FIG. 3 is a plan view of a fabric rose produced according to the method of the present invention.

Referring now to FIG. 3, a fabric rose, generally indicated at 100, is produced according to the present invention by utilizing the device, generally indicated at 10 in FIG. 1. To make a fabric rose, according to the present invention, a piece of ribbon having a desired length and width is selected. The ribbon is preferably single-faced or double-faced polyester satin ribbon, although double-faced ribbon is most preferred. Alternatively, ribbon and lace can be used together to form a rose. At one end of the selected piece of ribbon, the top edge is preferably folded toward the bottom edge. The end of the ribbon is then inserted between the needle devices, 20, 20', which are at rest. The chuck 18 is manipulated to narrow the distance between the needle devices 20,20' and maintain the end of the ribbon between the needle devices 20, 20'. The foot pedal device 26 is then depressed to activate the motor in motor box 16 and rotate the needle devices 20, 20' which, in turn, rotates the folded ribbon. The needle devices 20, 20' rotate the ribbon to form a tightly wrapped center 102 for a fabric rose. After the ribbon has rotated to form a sufficient center for a rose, the ribbon is folded numerous times in a direction away from the needle devices 20, 20' to form a multiplicity of petals 104 for a fabric rose. Depending upon the angle of the fold, different fabric rose styles and designs can be produced. The angle of the fold is, preferably, at least 45°. The size of the rose may be varied according to the length and width of the ribbon, as well as the number of folds in the ribbon to form the petals. An additional means for altering the style and size of the rose depends upon how tightly the ribbon is wrapped about the center of the rose.

Figure 4:
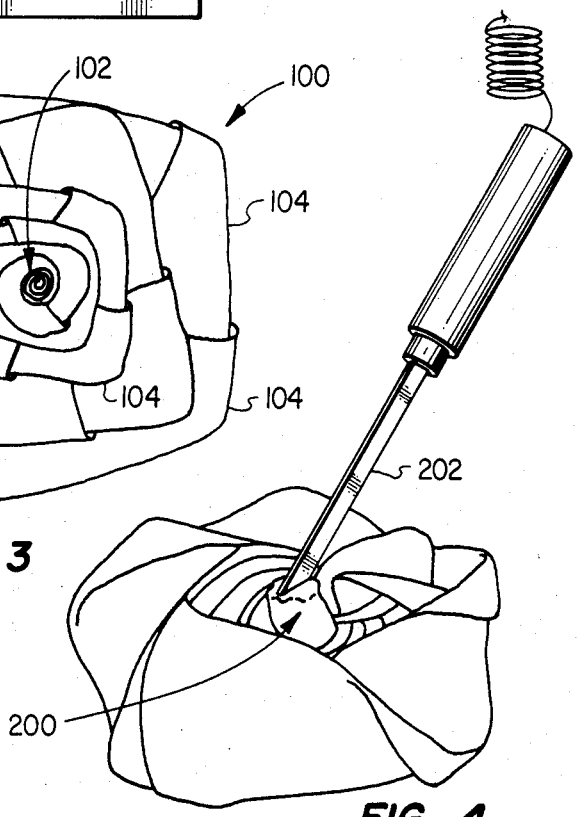
FIG. 4 is a plan view of a heated tip for sealing the base of a fabric rose produced according to the method of the present invention.

Upon completion of the desired number of petals, the chuck 18 is manipulated to increase the distance betwen the needle devices 20,20' so that the formed rose can be removed from the needle devices 20, 20'. The side of the rose that is selected to form the base is then heat sealed as shown in FIG. 4, by passing the base of the rose 200 over a heated blade 202, which heat seals or melts the ribbon fibers together. The heated blade may be heated by any known suitable means. Excess ribbon is removed in the same step since the ribbon is cut by the heated blade.

Various types of decorative leaves can be produced to be used in conjunction with the above-described fabric roses. One type of leaf can be hot cut from ribbon stock by gently pressing a selected piece of ribbon over a heated template having a desired leaf shape until the leaf is almost cut from the ribbon. Preferably, the template is formed so that a small portion of the cut leaf shape remains attached to the ribbon stock until the leaf is ready for use. Most preferably, the template is formed so that it will cut two joined leaves from the ribbon at a time. A second type of leaf can be produced by forming a loop with a selected piece of ribbon. The appearance of this type of leaf can be varied by twisting the ribbon to form figure-eight or other decorative shapes. Various other decorative items, such as lace, may be attached to the roses to enhance their esthetic appeal.

The above-described decorative items, such as leaves and lace, can be attached to the fabric roses in a similar manner as the heat sealing of the rose itself. More specifically, a soldering iron or other type of heated tip is utilized to heat seal the leaf or other decorative item to the rose by melting the fibers of the items and the rose together.

Clusters of the above-described fabric roses may be made by attaching a desired number of roses by means of hot glue. Also, when large roses are produced, for instance those having a diameter of at least 3½ inches, the petals are preferably sealed together with hot glue.

While preferred embodiments of the present invention have been shown and described, it will be apparent to persons skilled in the art that various changes and modifications can be made therein without departing from the spirit and scope of the invention which is defined by the appended claims.

What is claimed is:

1. A method for making fabric roses, comprising:

(a) rotating a length of fabric ribbon by means of a variable speed motor having a first needle device and a second needle device, said first and second needle devices holding one end of said ribbon therebetween;

(b) folding said fabric ribbon in a direction away from said first and second needle devices to form a multiplicity of petals of a fabric rose;

(c) removing said fabric rose from said first and second needle devices; and (d) sealing said fabric rose at a base portion thereof by heat-sealing means.

2. A method for making fabric roses according to claim 1, wherein said fabric ribbon is rotated to form a center portion for a fabric rose before said fabric ribbon is folded to form said multiplicity of petals.

3. A method for making fabric roses according to claim 1, wherein said fabric ribbon is folded at an angle of at least 45° to form said multiplicity of petals.

4. A method for making fabric roses according to claim 1, wherein said heat-sealing means comprise a heated blade.

5. A method for making fabric roses according to claim 4, wherein said heated blade melts said fabric ribbon.

6. A fabric rose produced by the method of claim 1.

7. A fabric rose according to claim 6, further comprising:

a decorative fabric leaf, a ribbon loop or lace.

8. A fabric rose, according to claim 7, wherein:

said decorative fabric leaf, ribbon loop or lace is heat-sealed to said fabric rose.

9. A fabric rose, comprising:

(a) a center;

(b) a multiplicity of petals surrounding said center; and, (c) a heat-sealed base at one end of said center; made by a method wherein a length of fabric ribbon is rotated to form said center by means of a variable speed motor having a first needle device and a second needle device, said first and second needle devices holding one end of said ribbon therebetween; and wherein after said center is formed, said fabric ribbon is folded in a direction away from said first and second needle devices to form said multiplicity of petals.

* * * * *